US012599167B2

(12) United States Patent
Faengler

(10) Patent No.: US 12,599,167 B2
(45) Date of Patent: Apr. 14, 2026

(54) CIGAR TRIMMER LIMITING DEVICE

(71) Applicant: Harry Faengler, Live Oak, TX (US)

(72) Inventor: Harry Faengler, Live Oak, TX (US)

( * ) Notice: Subject to any disclaimer, the term of this patent is extended or adjusted under 35 U.S.C. 154(b) by 138 days.

(21) Appl. No.: 18/598,886

(22) Filed: Mar. 7, 2024

(65) Prior Publication Data

US 2025/0280870 A1 Sep. 11, 2025

(51) Int. Cl.
*A24F 13/26* (2006.01)

(52) U.S. Cl.
CPC ..... *A24F 13/26* (2013.01)

(58) Field of Classification Search
CPC ..... A24F 13/26; A24F 13/24; A24F 13/18; A24F 13/47
USPC ..... 30/111, 109, 113, 94, 95; 131/248, 250, 131/252, 253, 257, 258
See application file for complete search history.

(56) References Cited

U.S. PATENT DOCUMENTS 1,049,445 A 1/1913 Bright
4,160,318 A * 7/1979 Morel ..... A24F 47/00 83/468
5,664,331 A 9/1997 Yu
D413,408 S 8/1999 White
6,164,286 A * 12/2000 Schad ..... A24F 13/26 30/109
10,736,353 B1 * 8/2020 Sharp ..... A24F 13/26
11,490,654 B2 * 11/2022 Doner ..... A24F 13/20
D982,229 S 3/2023 Cai
2023/0148079 A1 5/2023 Lucente
2023/0217993 A1 7/2023 Chen

FOREIGN PATENT DOCUMENTS

WO WO9911980 3/1999

* cited by examiner

*Primary Examiner* — Phong H Nguyen

(57) ABSTRACT

A cigar cutting device for cutting a head of a cigar at a precise length includes a cigar cutter that has a sleeve and a pair of blades each is slidably disposed in the sleeve. The cigar cutter has a cigar opening extending laterally through the sleeve to insertably receive a head of a cigar. Each of the pair of blades is slidable into a cutting position to cut the head of the cigar from the cigar. A stop is coupled to the sleeve and the stop is aligned with the cigar opening. In this way the stop abuts the head of the cigar when the cigar is extended through the cigar opening. Furthermore, the stop is offset from the sleeve a strategic distance to cut the head of the cigar at a preferred length for an optimum smoking experience.

5 Claims, 5 Drawing Sheets

CIGAR TRIMMER LIMITING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cutting devices and more particularly pertains to a new cutting device for cutting a head of a cigar at a precise length. The device includes a cigar cutter which includes a pair of blades and a cigar opening. The device includes a stop that is aligned with the cigar opening to inhibit the cigar from being extended too far through the cigar opening. In this way a head of the cigar can be cut at a precise length for an optimum smoking experience.

(2) Description of Related Art Including Information Disclosed Under 37 CFR 1.97 and 1.98

The prior art relates to cutting devices including a variety of cigar cutting devices that each at least includes a sleeve and a cigar hole extending through the sleeve and a pair of blades slidably disposed in the sleeve for cutting a head of a cigar that is extended into the cigar hole and a variety of cigar cutting devices that each at least includes a housing and a hemispherical depression in the housing and a single blade that is slidably integrated into the housing for cutting a head of a cigar that is positioned in the hemispherical depression. In no instance does the prior art disclose a cigar cutting device that includes a sleeve and a cigar hole extending through the sleeve and a pair of blades slidably disposed in the sleeve and a stop attached to the sleeve that is aligned with the cigar hole for aligning a cigar with the pair of blades to cut the head from the cigar at a precise length.

BRIEF SUMMARY OF THE INVENTION

An embodiment of the disclosure meets the needs presented above by generally comprising a cigar cutter that has a sleeve and a pair of blades each is slidably disposed in the sleeve. The cigar cutter has a cigar opening extending laterally through the sleeve to insertably receive a head of a cigar. Each of the pair of blades is slidable into a cutting position to cut the head of the cigar from the cigar. A stop is coupled to the sleeve and the stop is aligned with the cigar opening. In this way the stop abuts the head of the cigar when the cigar is extended through the cigar opening. Furthermore, the stop is offset from the sleeve a strategic distance to cut the head of the cigar at a preferred length for an optimum smoking experience.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
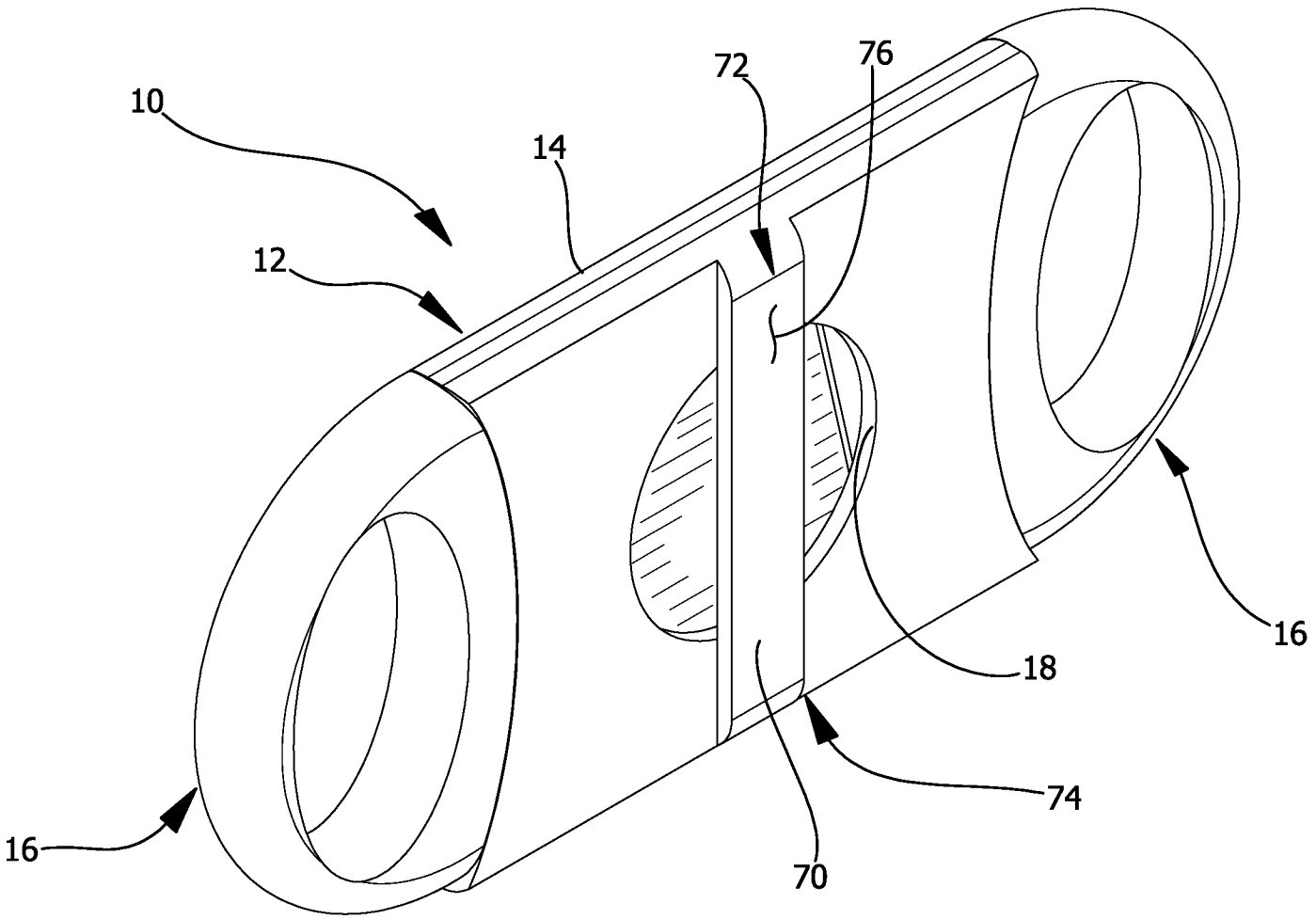
FIG. 1 is a back perspective view of a cigar cutting device according to an embodiment of the disclosure.
Figure 2:
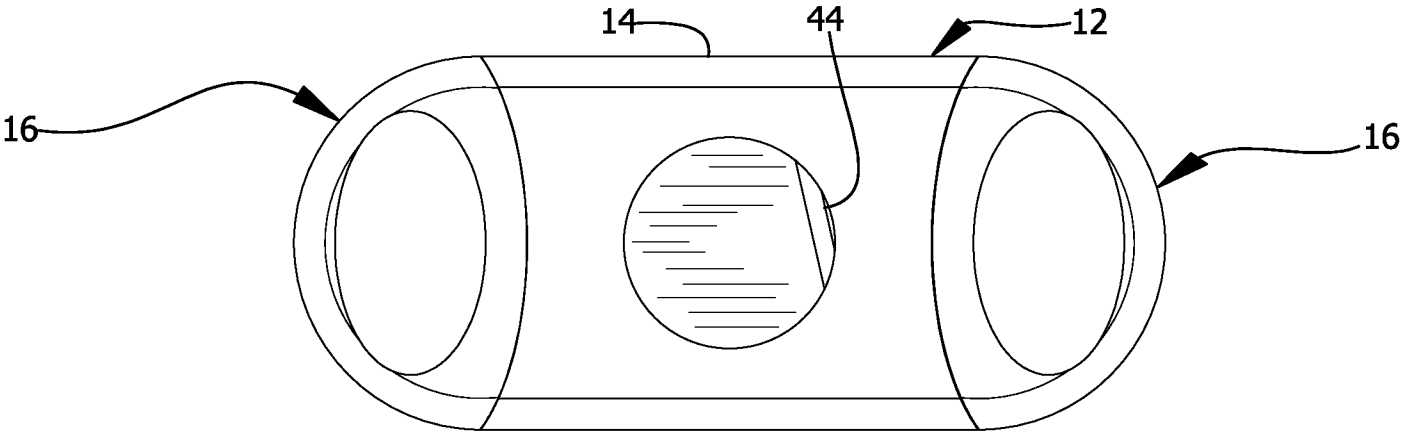
FIG. 2 is a front view of an embodiment of the disclosure showing a pair of blades in a cutting position.
Figure 3:
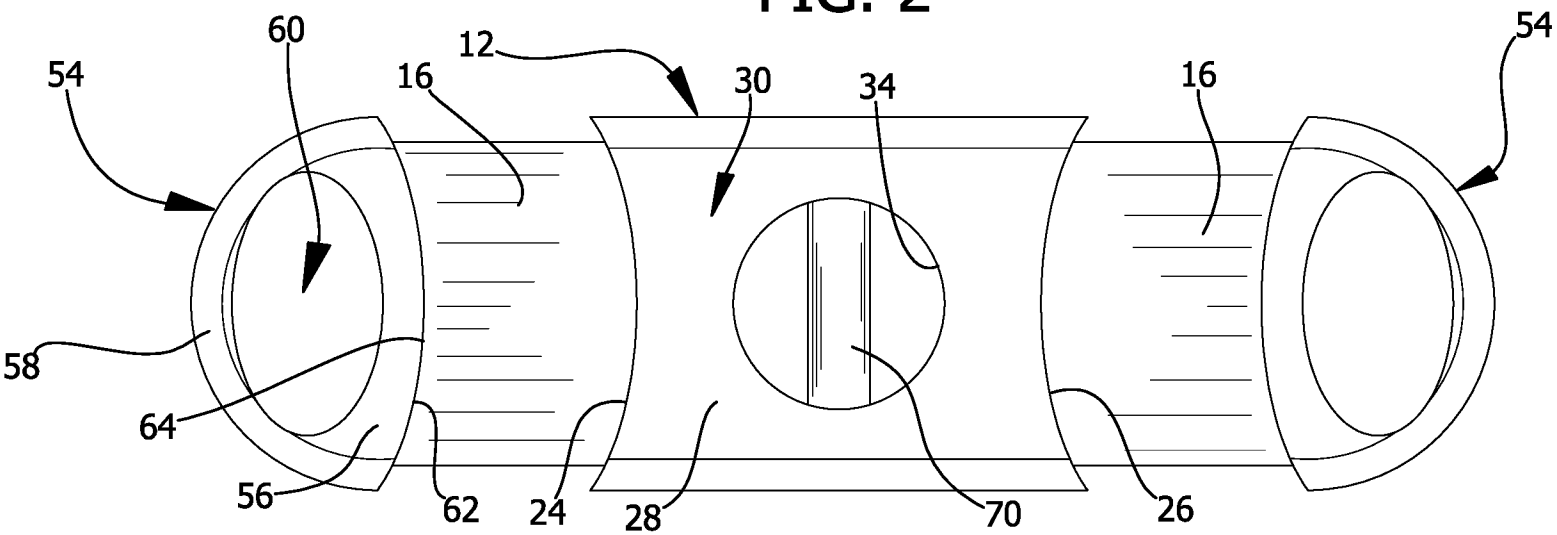
FIG. 3 is a front view of an embodiment of the disclosure showing a pair of blades in an open position.
Figure 4:
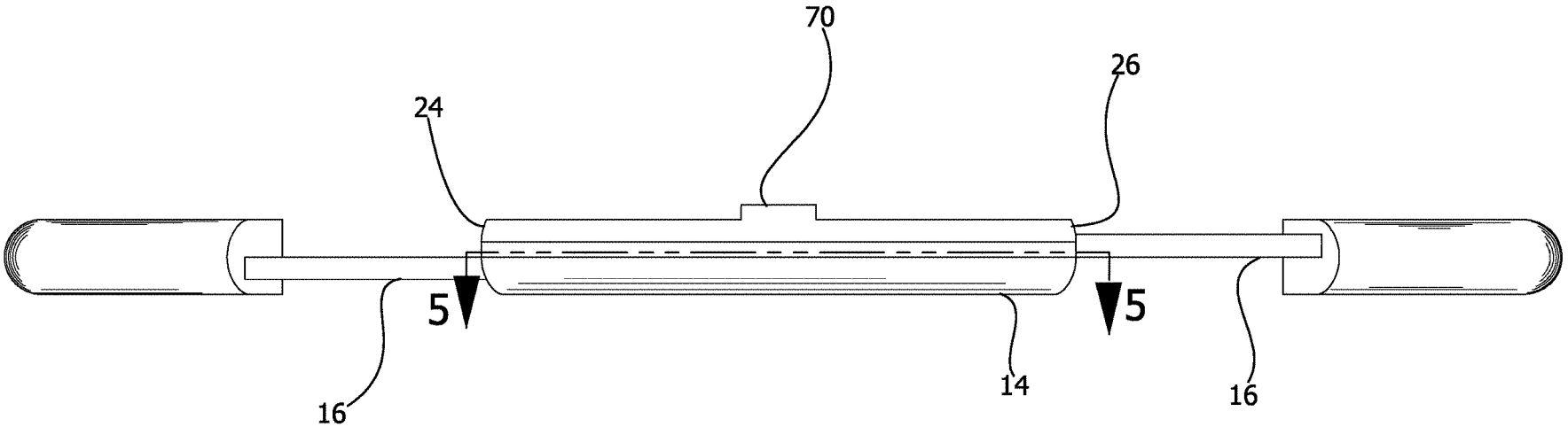
FIG. 4 is a top view of an embodiment of the disclosure.
Figure 5:
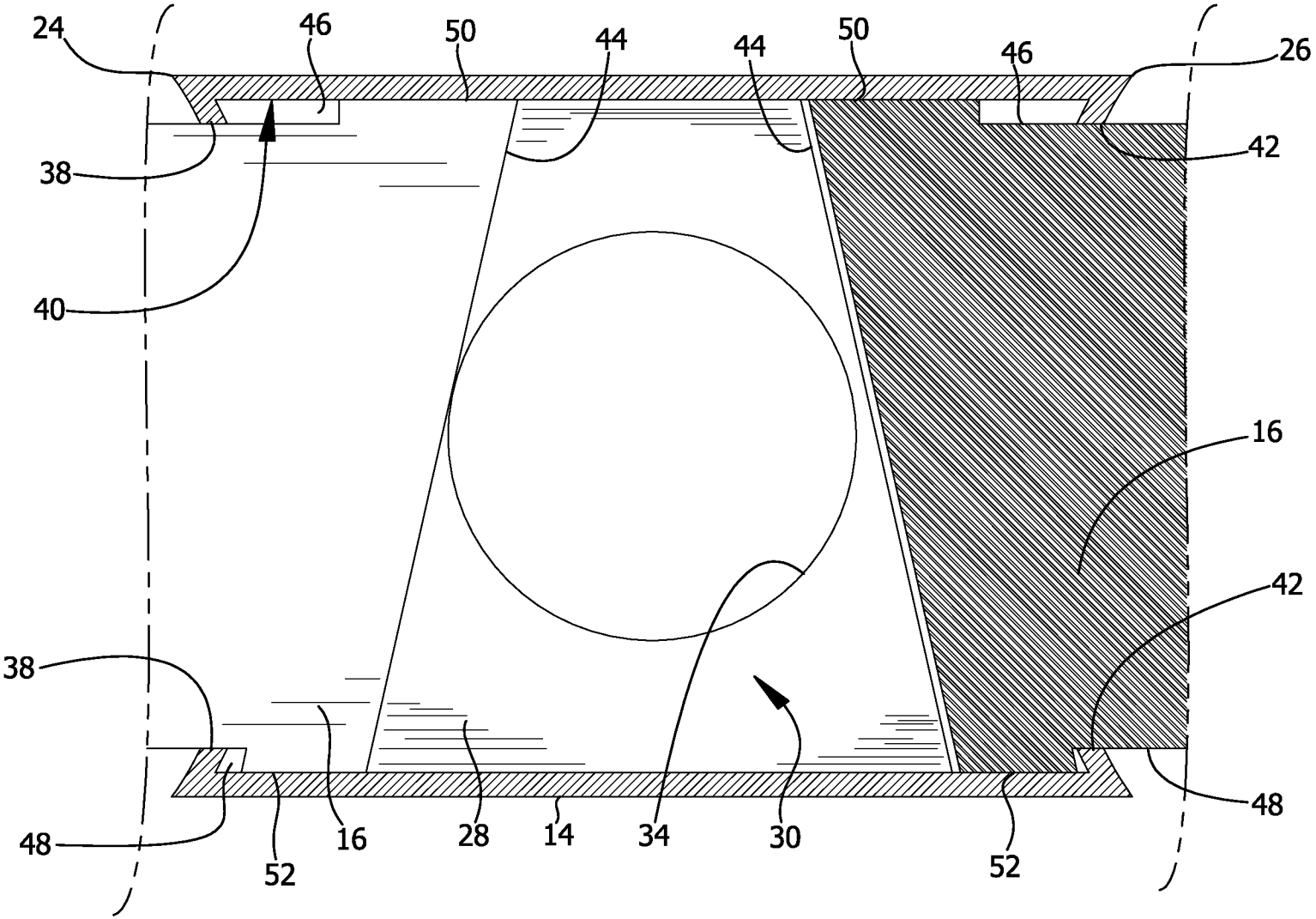
FIG. 5 is a cross sectional view taken along line 5-5 of FIG. 4 of an embodiment of the disclosure.
Figure 6:
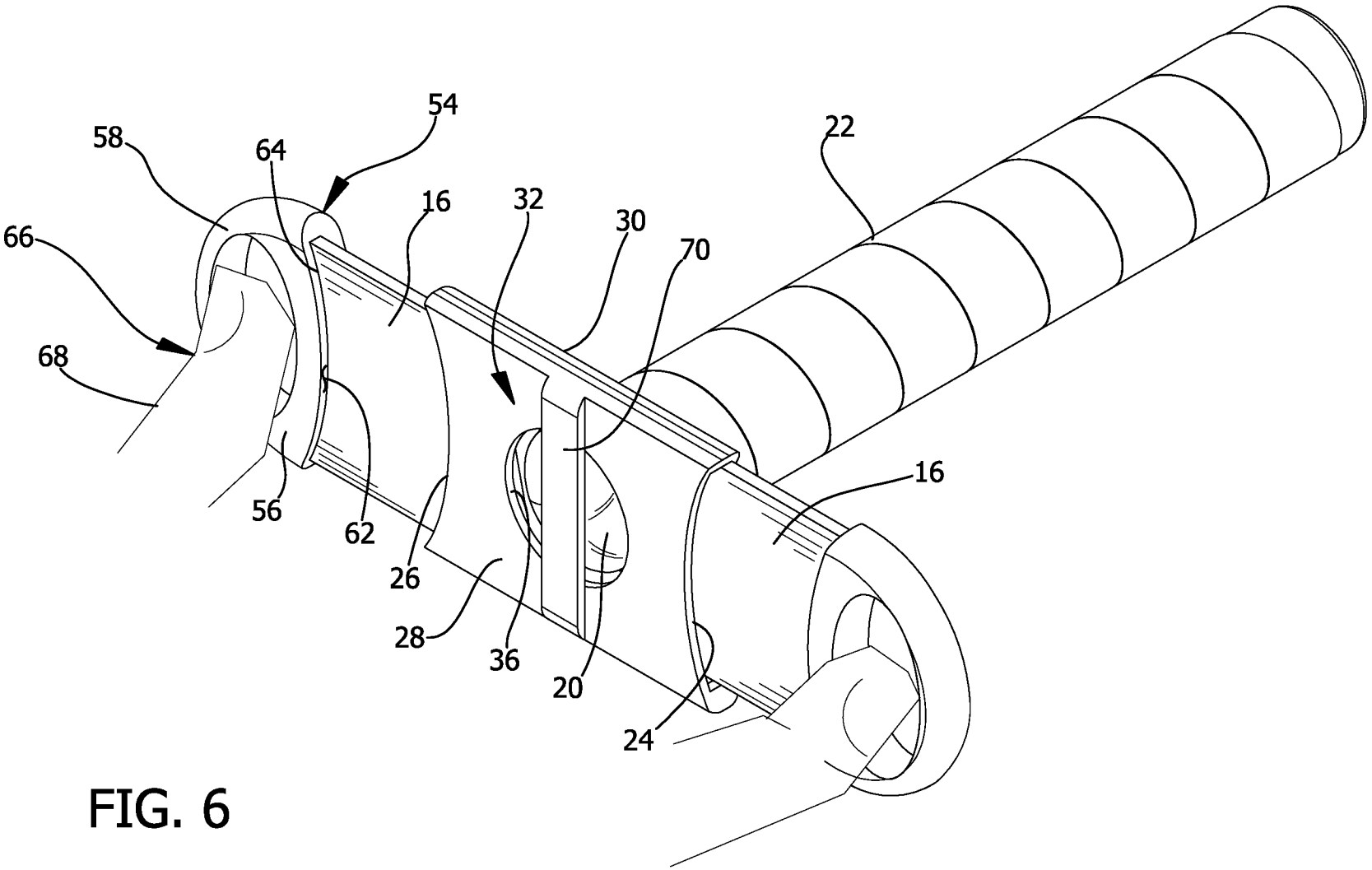
FIG. 6 is a perspective in-use view of an embodiment of the disclosure.

With reference now to the drawings, and in particular to FIGS. 1 through 6 thereof, a new cutting device embodying the principles and concepts of an embodiment of the disclosure and generally designated by the reference numeral 10 will be described.

As best illustrated in FIGS. 1 through 6, the cigar cutting device 10 generally comprises a cigar cutter 12 that has a sleeve 14 and a pair of blades 16 each slidably disposed in the sleeve 14. The cigar cutter 12 has a cigar opening 18 extending laterally through to insertably receive a head 20 of a cigar 22. Each of the pair of blades 16 is slidable into a cutting position having each of the pair of blades 16 sliding past each other in the cigar opening 18 to cut the head of the cigar 20 from the cigar 22. The sleeve 14 has a first end 24 and a second end 26 and an outer wall 28 extending between the first end 24 and the second end 26; each of the first end 24 and the second end 26 is open and the outer wall 28 has a front side 30 and a back side 32. Each of the first end 24 and the second end 26 is concavely arcuate with respect to an axis extending between the first end 24 and the second end 26 such that each of the first end 24 and the second end 26 curves toward each other.

The sleeve 14 has a first hole 34 extending through the front side 30 of the outer wall 28 and the first hole 34 is centrally located on the sleeve 14. The sleeve 14 has a second hole 36 extending through the back side 32 of the outer wall 28 and the second hole 36 is aligned with the first hole 34 such that each of the first hole 34 and the second hole 36 defines the cigar opening 18. The sleeve 14 has a pair of first tabs 38 each extending away from an inside surface 40 of the outer wall 28 of the sleeve 14. Each of the pair of first tabs 38 is positioned on an opposing side of the first end 24 of the sleeve 14 with respect to each other and each of the pair of first tabs 38 angles toward the second end 26. The sleeve 14 has a pair of second tabs 42 each extending away from an inside surface 40 of the outer wall 28 of the sleeve 14. Each of the pair of second tabs 42 is positioned on an opposing side of the second end 26 of the sleeve 14 with respect to each other and each of the pair of second tabs 42 angles toward the first end 24.

Each of the pair of blades 16 extends through a respective one of the first end 24 and the second end 26 of the sleeve 14 and each of the pair of blades 16 has a cutting edge 44 that is positioned within the sleeve 14. The cutting edge 44 on each of the pair of blades 16 angles away from each other such that the cutting edge 44 on each of the pair of blades 16 crosses each other at an acute angle in the cigar opening 18 when the pair of blades 16 is slid into the cutting position. In this way the cutting edge 44 on each of the pair of blades 16 cleanly slices through the cigar 22 rather than potentially pressing against the cigar 22 if the cutting edge 44 of each of the pair of blades 16 was horizontally oriented.

Each of the pair of blades 16 has a top edge 46 and a bottom edge 48. The top edge 46 of each of the pair of blades 16 has a first prominence 50 which abuts a respective one of the pair of the first tabs 38 and a respective one of the pair of second tabs 42 when the pair of blades 16 is slid into an open position. In this way the first prominence 50 of each of the pair of blades 16 inhibits the pair of blades 16 from being removed from the sleeve 14. The bottom edge 48 of each of the pair of blades 16 has a second prominence 52 which abuts a respective one of the pair of the first tabs 38 and a respective one of the pair of second tabs 42 when the pair of blades 16 is slid into an open position. In this way the second prominence 52 of each of the pair of blades 16 inhibits the pair of blades 16 from being removed from the sleeve 14.

A pair of handles 54 is provided and each of the pair of handles 54 has a first member 56 and a second member 58 arcing away from the first member 56 to define a finger hole 60 between the first member 56 and the second member 58. The first member 56 of each of the pair of handles 54 has an outwardly facing surface 62 which curves away from the finger hole 60. Additionally, the outwardly facing surface 62 of the first member 56 of each of the pair of handles 54 is coupled to a free edge 64 of a respective one of the pair of blades 16. Furthermore, the outwardly facing surface 62 of the first member 56 of each of the pair of handles 54 abuts a respective one of the first end 24 and the second end 26 of the sleeve 14 when the blades 16 are slid into the cutting position. The finger hole 60 defined in each of the pair of handles 54 facilitates the respective blade 16 to be gripped for sliding the respective blade 16 between the cutting position and the open position. Additionally, the finger hole 60 defined in each of the pair of handles 54 is elongated with respect to an axis extending between the top edge 46 and the bottom edge 48 of the respective blade 16 such that the finger hole 60 defined in each of the pair of handles 54 has an ovoid shape. In this way the finger hole 60 defined in each of the pair of handles 54 enhances comfort for a user 66 when the user 66 extends their fingers 68 through the finger hole 60 defined in each of the pair of handles 54.

A stop 70 is coupled to the sleeve 14 and the stop 70 is aligned with the cigar opening 18. In this way the stop 70 abuts the head of the cigar 20 when the cigar 22 is extended through the cigar opening 18. Furthermore, the stop 70 is offset from the sleeve 14 a strategic distance which may range between approximately 2.0 mm and 4.0 mm. In this way, in combination with the thickness of the sleeve 14 which may range between approximately 4.0 mm and 6.0 mm, the stop 70 strategically aligns the cigar 22 with the pair of blades 16 when the head of the cigar 20 abuts the stop 70 to cut the head of the cigar 20 at a preferred length for an optimum smoking experience. The stop 70 lies flat on the back side 32 of the outer wall 28 of the sleeve 14 and the stop 70 is elongated to extend along a full height of the sleeve 14. Furthermore, the stop 70 is positioned to bisect the second hole 36 in the back side 32 of the outer wall 28 of the sleeve 14. The stop 70 has an upper end 72 and a lower end 74 and an exposed surface 76 extending between the upper end 72 and the lower end 74. Additionally, each of the upper end 72 and the lower end 74 is curved between the exposed surface 76 and the back side 32 of the outer wall 28 of the sleeve 14.

In use, the blades 16 are slid into the open position and the head of the cigar 20 is inserted into the cigar 22 hole until the head of the cigar 20 abuts the stop 70. In this way the cigar 22 is inhibited from being extended too far through the cigar cutter 12. The pair of blades 16 are urged into the cutting position thereby cutting the head from the cigar 22 at a precise length. In this way the user 66 can consistently cut the head of a cigar 22 at the precise length for the optimum smoking experience.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cigar cutting device for cutting an end of a cigar to a predetermined length thereby ensuring a consistent smoking experience, said device comprising:

a cigar cutter having a sleeve and a pair of blades each being slidably disposed in said sleeve, said cigar cutter having a cigar opening extending laterally through said sleeve wherein said cigar opening is configured to insertably receive a head of a cigar, each of said pair of blades being slidable into a cutting position having each of said pair of blades sliding past each other in said cigar opening wherein said pair of blades is configured to cut the head of the cigar from the cigar; and a stop being coupled to said sleeve, said stop being aligned with said cigar opening wherein said stop is configured to abut the head of the cigar when the cigar is extended through said cigar opening, said stop being offset from said sleeve a strategic distance wherein said stop is configured to strategically align the cigar with said pair of blades when the head of the cigar abuts said stop to cut the head of the cigar at a preferred length for an optimum smoking experience;

wherein said sleeve has a first end and a second end and an outer wall extending between said first end and said second end;

wherein each of said first end and said second end is open;

wherein said outer wall has a front side and a back side;

wherein each of said first end and said second end is concavely arcuate with respect to an axis extending between said first end and said second end such that each of said first end and said second end curves toward each other;

wherein said sleeve has a first hole extending through said front side of said outer wall;

wherein said first hole is centrally located on said sleeve;

wherein said sleeve has a second hole extending through said back side of said outer wall;

wherein said second hole is aligned with said first hole such that each of said first hole and said second hole defines said cigar opening;

wherein said stop lies flat on said back side of said outer wall of said sleeve;

wherein said stop is elongated to extending along a full height of said sleeve;

wherein said stop is positioned to bisect said second hole in said back side of said outer wall of said sleeve;

wherein said stop has an upper end and a lower end and an exposed surface extending between said upper end and said lower end; and wherein each of said upper end and said lower end is curved between said exposed surface and said back side of said outer wall of said sleeve.

2. The device according to claim 1, wherein:

said sleeve has a pair of first tabs each extending away from an inside surface of said outer wall of said sleeve;

each of said pair of first tabs is positioned on an opposing side of said first end of said sleeve with respect to each other;

each of said pair of first tabs angles toward said second end;

said sleeve has a pair of second tabs each extending away from an inside surface of said outer wall of said sleeve;

each of said pair of second tabs is positioned on an opposing side of said second end of said sleeve with respect to each other; and each of said pair of second tabs angles toward said first end.

3. The device according to claim 2, wherein:

each of said pair of blades extends through a respective one of said first end and said second end of said sleeve;

each of said pair of blades has a cutting edge being positioned within said sleeve;

said cutting edge on each of said pair of blades angles away from each other such that said cutting edge on each of said pair of blades crosses each other at an acute angle in said cigar opening when said pair of blades is slid into said cutting position wherein said cutting edge on each of said pair of blades is configured to cleanly slice through the cigar;

each of said pair of blades has a top edge and a bottom edge;

said top edge of each of said pair of blades has a first prominence which abuts a respective one of said pair of said first tabs and a respective one of said pair of second tabs when said pair of blades is slid into an open position such that said first prominence of each of said pair of blades inhibits said pair of blades from being removed from said sleeve; and said bottom edge of each of said pair of blades has a second prominence which abuts a respective one of said pair of said first tabs and a respective one of said pair of second tabs when said pair of blades is slid into an open position such that said second prominence of each of said pair of blades inhibits said pair of blades from being removed from said sleeve.

4. The device according to claim 1, wherein:

said device includes a pair of handles;

each of said pair of handles has a first member and a second member arcing away from said first member to define a finger hole between said first member and said second member;

said first member of each of said pair of handles has an outwardly facing surface which curves away from said finger hole;

said outwardly facing surface of said first member of each of said pair of handles is coupled to a free edge of a respective one of said pair of blades such that said outwardly facing surface of said first member of each of said pair of handles abuts a respective one of said first end and said second end of said sleeve when said blades are slid into said cutting position;

said finger hole defined in each of said pair of handles facilitates said respective blade to be gripped for sliding said respective blade between said cutting position and said open position; and said finger hole defined in each of said pair of handles is elongated with respect to an axis extending between said top edge and said bottom edge of said respective blade such that said finger hole defined in each of said pair of handles has an ovoid shape wherein said finger hole defined in each of said pair of handles is configured to enhance comfort for a user when the user extends their fingers through said finger hole defined in each of said pair of handles.

5. A cigar cutting device for cutting an end of a cigar to a predetermined length thereby ensuring a consistent smoking experience, said device comprising:

a cigar cutter having a sleeve and a pair of blades each being slidably disposed in said sleeve, said cigar cutter having a cigar opening extending laterally through said sleeve wherein said cigar opening is configured to insertably receive an end of a cigar, each of said pair of blades being slidable into a cutting position having each of said pair of blades sliding past each other in said cigar opening wherein said pair of blades is configured to cut the head of the cigar from the cigar;

wherein said sleeve has a first end and a second end and an outer wall extending between said first end and said second end, each of said first end and said second end being open, said outer wall having a front side and a back side, each of said first end and said second end being concavely arcuate with respect to an axis extending between said first end and said second end such that each of said first end and said second end curves toward each other, said sleeve having a first hole extending through said front side of said outer wall, said first hole being centrally located on said sleeve, said sleeve having a second hole extending through said back side of said outer wall, said second hole being aligned with said first hole such that each of said first hole and said second hole defines said cigar opening, said sleeve having a pair of first tabs each extending away from an inside surface of said outer wall of said sleeve, each of said pair of first tabs being positioned on an opposing side of said first end of said sleeve with respect to each other, each of said pair of first tabs angling toward said second end, said sleeve having a pair of second tabs each extending away from an inside surface of said outer wall of said sleeve, each of said pair of second tabs being positioned on an opposing side of said second end of said sleeve with respect to each other, each of said pair of second tabs angling toward said first end;

wherein each of said pair of blades extends through a respective one of said first end and said second end of said sleeve, each of said pair of blades having a cutting edge being positioned within said sleeve, said cutting edge on each of said pair of blades angling away from each other such that said cutting edge on each of said pair of blades crosses each other at an acute angle in said cigar opening when said pair of blades is slid into said cutting position wherein said cutting edge on each of said pair of blades is configured to cleanly slice through the cigar, each of said pair of blades having a top edge and a bottom edge, said top edge of each of said pair of blades having a first prominence which abuts a respective one of said pair of said first tabs and a respective one of said pair of second tabs when said pair of blades is slid into an open position such that said first prominence of each of said pair of blades inhibits said pair of blades from being removed from said sleeve, said bottom edge of each of said pair of blades having a second prominence which abuts a respective one of said pair of said first tabs and a respective one of said pair of second tabs when said pair of blades is slid into an open position such that said second prominence of each of said pair of blades inhibits said pair of blades from being removed from said sleeve;

a pair of handles, each of said pair of handles having a first member and a second member arcing away from said first member to define a finger hole between said first member and said second member, said first member of each of said pair of handles having an outwardly facing surface which curves away from said finger hole, said outwardly facing surface of said first member of each of said pair of handles being coupled to a free edge of a respective one of said pair of blades such that said outwardly facing surface of said first member of each of said pair of handles abuts a respective one of said first end and said second end of said sleeve when said blades are slid into said cutting position, said finger hole defined in each of said pair of handles facilitating said respective blade to be gripped for sliding said respective blade between said cutting position and said open position, said finger hole defined in each of said pair of handles being elongated with respect to an axis extending between said top edge and said bottom edge of said respective blade such that said finger hole defined in each of said pair of handles has an ovoid shape wherein said finger hole defined in each of said pair of handles is configured to enhance comfort for a user when the user extends their fingers through said finger hole defined in each of said pair of handles; and a stop being coupled to said sleeve, said stop being aligned with said cigar opening wherein said stop is configured to abut the head of the cigar when the cigar is extended through said cigar opening, said stop being offset from said sleeve a strategic distance wherein said stop is configured to strategically align the cigar with said pair of blades when the head of the cigar abuts said stop to cut the head of the cigar at a preferred length for an optimum smoking experience, said stop lying flat on said back side of said outer wall of said sleeve, said stop being elongated to extending along a full height of said sleeve, said stop being positioned to bisect said second hole in said back side of said outer wall of said sleeve, said stop having an upper end and a lower end and an exposed surface extending between said upper end and said lower end, each of said upper end and said lower end being curved between said exposed surface and said back side of said outer wall of said sleeve.

* * * * *